US005252080A

United States Patent [19]

Pesson

[11] Patent Number: 5,252,080

[45] Date of Patent: Oct. 12, 1993

[54] PRESS-FIT PRINTED CIRCUIT BOARD CONNECTOR

[75] Inventor: Michel Pesson, Sille le Philippe, France

[73] Assignee: Souriau et Cie, France

[21] Appl. No.: 985,481

[22] Filed: Dec. 2, 1992

[30] Foreign Application Priority Data

Dec. 10, 1991 [FR] France ..... 91 15295

[51] Int. Cl.[5] ..... H01R 9/09

[52] U.S. Cl. ..... 439/79; 439/80; 439/82

[58] Field of Search ..... 439/78-82, 439/84

[56] References Cited

U.S. PATENT DOCUMENTS

| | | | |
|---|---|---|---|
| 3,864,000 | 6/1973 | Coller et al. . | |
| 4,050,769 | 9/1977 | Ammon | 439/79 |
| 4,125,935 | 6/1977 | Ammon et al. . | |
| 4,869,677 | 9/1989 | Johnson et al. | 439/80 |
| 4,946,400 | 8/1990 | Kawai et al. | 439/79 |
| 4,955,819 | 9/1990 | Harting et al. | 439/79 |
| 4,983,127 | 1/1991 | Kawai et al. | 439/79 |
| 4,986,772 | 1/1991 | Fukutami | 439/79 |
| 5,090,912 | 2/1992 | Zell | 439/82 |

*Primary Examiner*—Paula A. Bradley

*Attorney, Agent, or Firm*—Andrus, Sceales, Starke & Sawall

[57] ABSTRACT

A press-fit connector has an insulative body carrying a series of right-angle pins one branch of which can be force-fitted into a through-plated hole in a printed circuit. The insulative body comprises an angle-bracket having a mounting flange whose outside surface is adapted to bear against the board and a pressure block with bearing surfaces adapted to bear against the pins in order to apply to them a force which forces them into the through-plated holes and other bearing surfaces adapted to bear against the mounting flange. The geometry of the assembly is such that when the first bearing surfaces bear without external loading on the pins there remains a clearance between the second bearing surfaces and the mounting flange which is greater than the permanent deformation of the pins and the insulative body after the pins are forced in and the external loading is removed, so that the angle-bracket is held perfectly against the board.

1 Claim, 2 Drawing Sheets 700
200
260
$J_1=0$
300
$J_2$
113
230
500
510
220
110
250
124
100
120

220
300
500
240
120
110

700
300
200
114
500
113
$J_3=J_2$
510
F
310
220
230
260
110
112
100
120

500
240
120
110

700
$J_4$
500
300
$J_3=0$
200
113
230
110
112
100
120
400
d 500
240
120
110

PRESS-FIT PRINTED CIRCUIT BOARD CONNECTOR

BACKGROUND OF THE INVENTION

1. Field of the Invention

The present invention concerns a press-fit printed circuit board connector.

2. Description of the Prior Art

A press-fit connector comprises an electrically insulative body carrying a series of right-angled pins whose proximal branches (relative to the printed circuit board) are essentially perpendicular to the board and have a profile enabling them to be force-fitted into through-plated holes in the printed circuit and whose distal branches are essentially parallel to the board and configured as male or female connecting members.

In theory the pins are forced-fitted into the through-plated holes of the board once and for all, but it is possible to demount the connector two or three times, to carry out repairs for example. The connecting members carried by the distal branches of the pins are intended to provide an essentially demountable electrical connection, typically in the form of a socket on one side of a casing enclosing the electronic circuit board on which the connector is mounted.

A press-fit connector is usually mounted on the board by pressing directly on the bent portions of the pins in order to force them into the aligned through-plated holes.

A first drawback of this operation is that it requires tooling specific to each connector in order to apply pressure simultaneously and uniformly to each pin of the connector.

Another drawback of these known connectors is that, after the pins are completely forced into the through-plated holes and after the pressure on the mounting tool is released, because of the removal of the load and because of the permanent deformations to which the various parts of the connector are subjected the insulative body carrying the pins is slightly spaced from the surface of the board, by a more or less random amount, rather than remaining perfectly in contact with the board.

The gap is found to be particularly disadvantageous in practice because the mechanical stiffness of the connector-board coupling depends on the perfect placing of the insulative body against the board and because the gap degrades the dimensional accuracy with which the male or female connecting members carried by the distal branches of the pins are positioned.

These connecting members are essentially parallel to the board and if the connector is not pressed perfectly against the board the axis of the connecting members is offset radially relative to the position that it should occupy, so impeding the subsequent obtaining of a satisfactory mechanical and electrical coupling: the consequence of this is that when the board fitted with its connector is placed in the casing adapted to receive it the connecting members will not be accurately located relative to the casing at the exact position that they would have occupied if the connector insulative body had remained perfectly in contact with the board surface.

One object of the invention is to remedy these various drawbacks by proposing a new press-fit connector structure which does not require any dedicated tooling for mounting it on the board, with correlative advantages of simplicity and low cost, and which also guarantees that the insulative body carrying the pins is systematically placed so that the geometrical position of the connecting members relative to the casing is perfectly defined.

SUMMARY OF THE INVENTION

The invention consists in a press-fit connector adapted to be fitted to a printed circuit board comprising an insulative body carrying a series of right-angled pins the proximal branches of which are substantially perpendicular to a board and have a profile enabling them to be force-fitted into through-plated holes of the printed circuit and the distal branches of which are substantially parallel to the board and configured as male or female connecting members, in which the connector insulative body comprises:

a part having the general shape of an angle-bracket with one flange substantially parallel to the board constituting a mounting flange whose outside surface is adapted to bear against the surface of the board and whose other flange is essentially perpendicular to the board and constitutes a connecting flange to which the distal branches of the pins are fastened, and a part constituting a pressure block having:

first bearing surfaces adapted to bear against the distal branches of the pins so as to exert on the latter by virtue of application of a force urging the block in a direction perpendicular to the board a force forcing the pins into respective through-plated holes, and bearing surfaces adapted to bear against the lower surface of the mounting flange of the angle-bracket, the relative position of the first and second bearing surfaces being such that when the first bearing surfaces bear without clearance on the pins there remains a clearance between the second bearing surfaces and the inside surface of the mounting flange which is less than the elastic deformation under load perpendicular to the board of the pins when the force is applied whereby the mounting flange is urged against the board concomitantly with forcing of the pins into the through-plated holes, the clearance being greater than the permanent deformation perpendicular to the board of the pins and the insulative body after the pins are forced in completely and the load is removed, whereby the mounting side of the angle-bracket is held against the board.

One embodiment of a connector in accordance with the invention will now be described with reference to the appended drawings in which the same components are always identified by the same reference numbers.

DETAILED DESCRIPTION OF THE INVENTION

Figure 1:
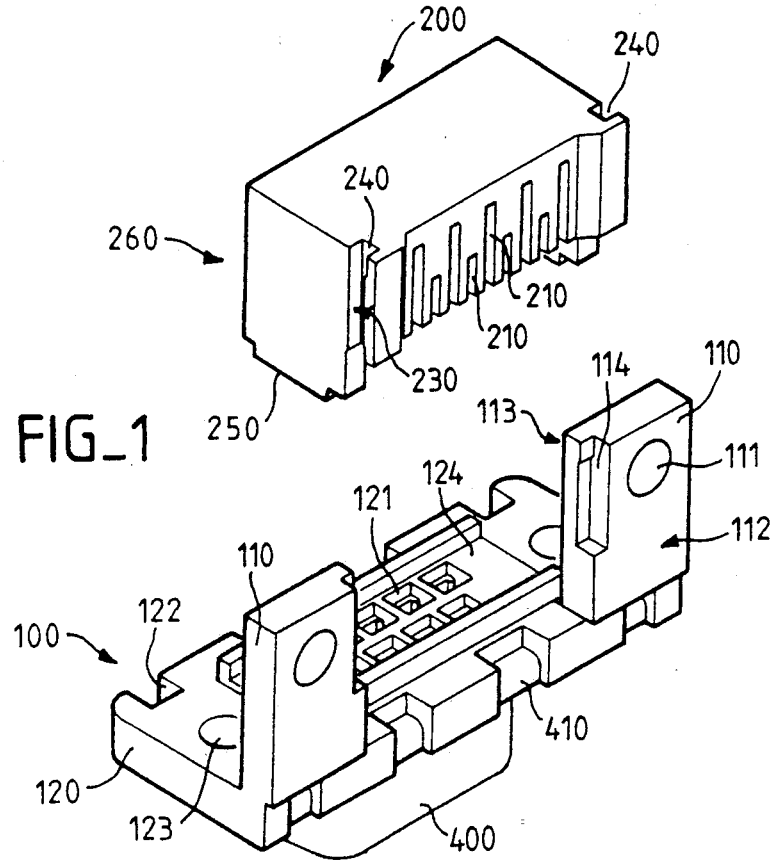
FIG. 1 is an exploded perspective view showing the construction of the connector insulative body.
Figure 2:
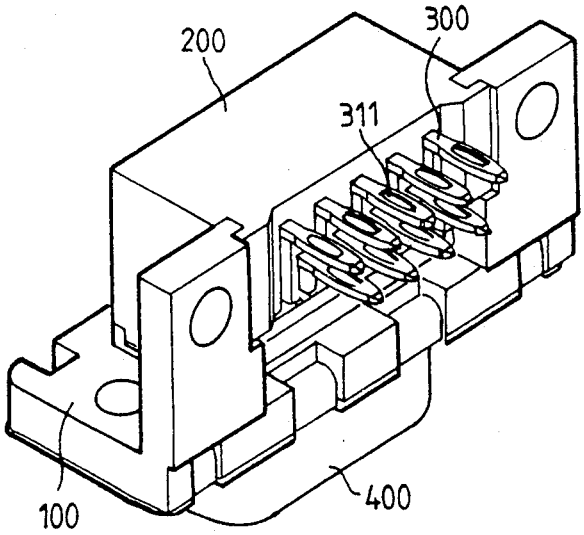
FIG. 2 shows a connector in accordance with the invention in perspective with its various component parts assembled together ready to be fitted to a printed circuit board.
Figure 3:
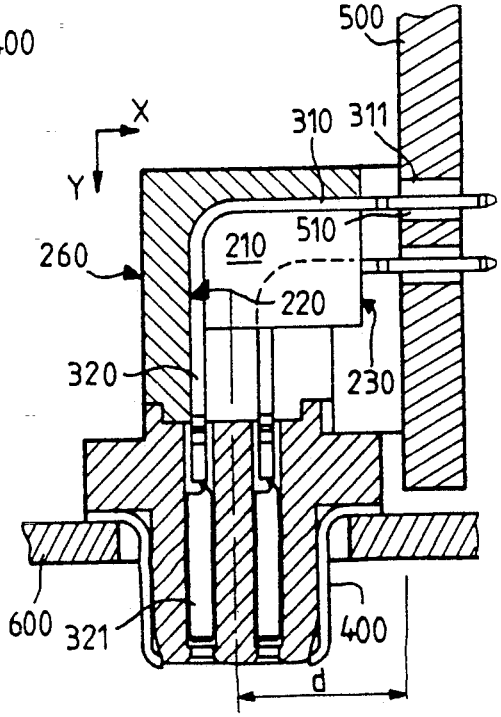
FIG. 3 is an elevation view in cross-section of the connector from FIG. 2.

The connector in accordance with the invention shown by way of example in various aspects in FIGS. 1 through 3 essentially comprises an insulative body in two parts 100, 200 and a series of right-angle metal pins 300 terminating in a metal casing 400 constituting a shielding enclosure.

The part 100 is essentially angle-bracket shape having a first flange 110 parallel to the board 500 (FIG. 3) against which it will subsequently be located and which is referred to hereinafter as the "mounting flange" and a second flange 120 perpendicular to the flange 110 referred to hereinafter as the "connecting flange". The flange 110 comprises two holes 111 enabling additional fixing to the board or positioning of the angle-bracket relative to centering pins defined on the board should this be necessary. The side 112 of the mounting flange facing towards the board subsequently comes into contact with the surface of the latter and will also be used as a reference surface relative to which the geometrical position of the various component parts is defined.

The connecting flange 120 incorporates a number of cells 121 which receive the right-angled pins and notches 122 enabling the metal casing 400 to be fixed by crimping lugs 410 thereon. The connecting flange 120 also includes holes 123 whereby the connector may be mechanically fastened to the casing 600 containing all of the component parts, for example.

The other part of the connector insulative body is the part 200 referred to hereinafter as the "pressure block" and is of generally parallelepiped shape. This block has on the side facing towards the board notches 210 in the bottom of which the right-angled pins 300 are located, as can be seen more clearly in FIG. 3, the pins bearing on the bottom 220 of the notches 210. The block further comprises front surfaces 230 defined (for example) by one of the lateral walls of grooves 240 and adapted to bear against the inside surface 113 of the mounting flange 110 in a manner to be described in more detail later.

The block 200 is nested over the angle-bracket 100 and to this end comprises a projection 250 locating in a counterpart recess 124 on the connecting flange 120 of the angle-bracket; also, the grooves 240 cooperate with counterpart ribs 114 on the mounting flange 110. The pressure block 200 finally comprises an essentially plane rear surface 260 against which pressure is applied when the connector is mounted on the board.

The right-angled general configuration of the pins is shown in FIG. 3. The pins comprise a first branch 310 referred to hereinafter as the "proximal branch" shaped as shown at 311 to enable them to be force-fitted into a through-plated hole of the printed circuit. The other branch 320 referred to hereinafter as the "distal branch" is perpendicular to the branch 210 and therefore parallel to the board; its end is configured, as shown at 321, as a male or female connecting member (a female pin in the example shown in the figure) so as to form in combination with the metal casing 400 a connection system protruding from the casing 600 in which the connector and the board are mounted, for example.

It is seen that the dimensional accuracy of the positioning of the connector relative to the casing 600 depends on the dimension d, i.e. the distance between the transverse axis of the connecting flange 120 and the surface of the board 500. This means that any defective positioning of the angle-bracket against the board results in defective location of the connector relative to the casing 600.

The manner in which the connector is mounted on the printed circuit board will now be described with reference to FIGS. 4 through 9.

Figure 4:
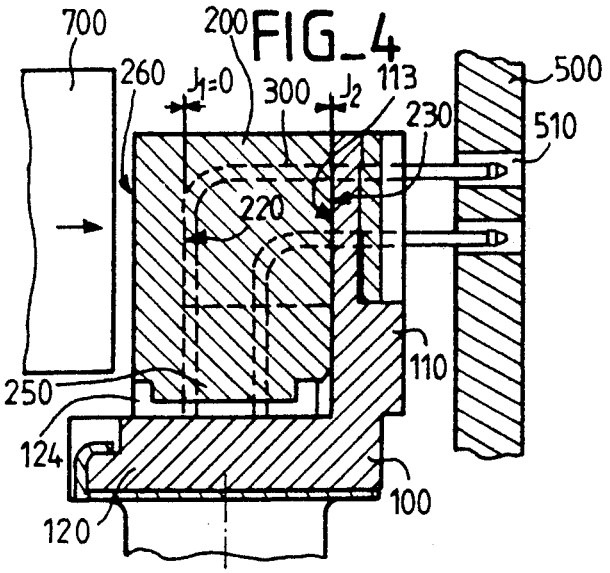
FIGS. 4 and 5 are respectively elevation and plan views of the connector in accordance with the invention in cross-section during a first phase of mounting it on the printed circuit board.
Figure 5:
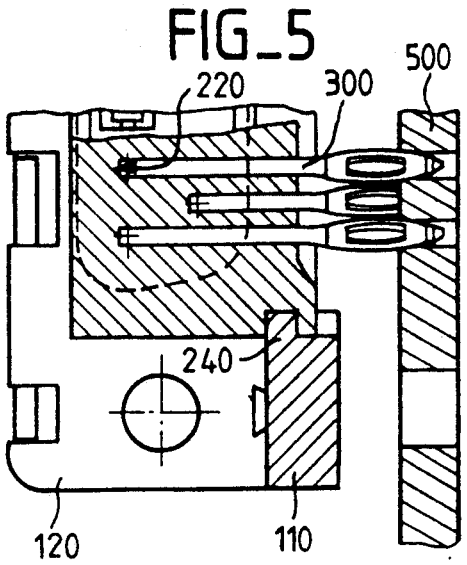

In a first phase of the mounting operation shown in FIGS. 4 and 5 the connector is offered up facing the board without applying any external force.

In this condition, i.e. the rest state of the various parts, the distal branches 220 of the pins bear without clearance ($J_1=0$) against the bottom of the notches 210 accommodating the pins. With regard to the relative position of the angle-bracket 100 and the pressure block 200, the dimensions of these parts are such that when the aforementioned bearing condition ($J_1=0$) is verified there remains a residual clearance $J_2$ between the front surface 230 of the pressure block 200 and the lower surface 113 of the mounting flange 110 of the angle-bracket 100; the designed value of this clearance whereby the connector is able to fulfill the intended function will be explained later.

Figure 6:
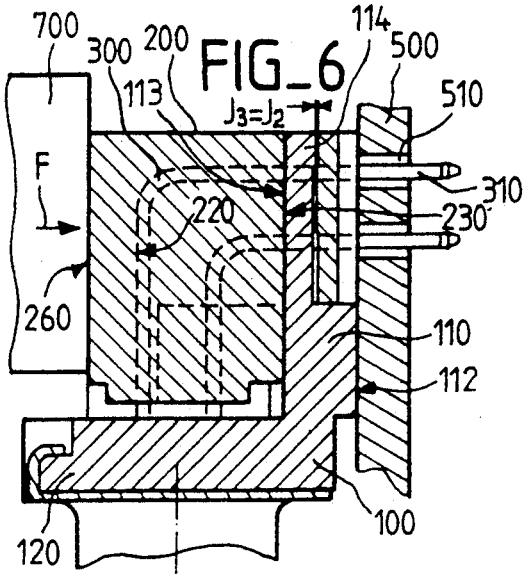
FIGS. 6 and 7 are counterparts of FIGS. 4 and 5 for a second phase of the mounting operation.
Figure 7:
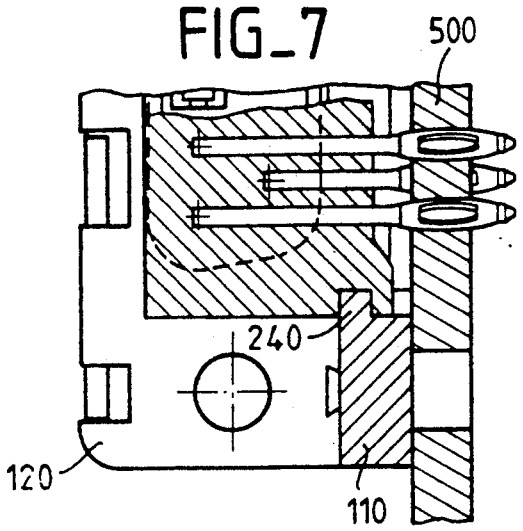
Figure 8:
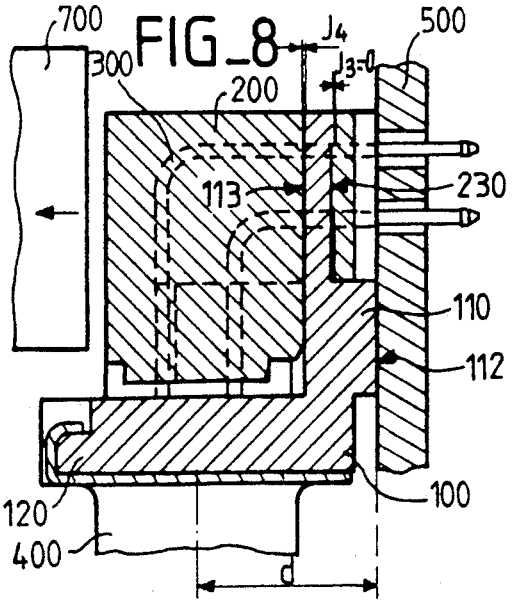
FIGS. 8 and 9 are counterparts of FIGS. 4 and 5 for a third phase of the mounting operation.
Figure 9:
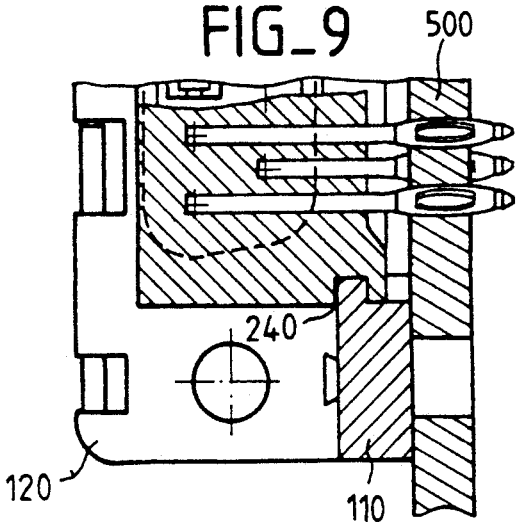

In a second phase of the mounting operation shown in FIG. 6 and 7 a tool 700 is pressed against the rear surface 260 of the pressure block 200. This may be a very simple tool, for example a tool with a simple plane surface to which a force F is applied in order to urge the pressure block 200—and therefore the entire connector with its pins—in a direction perpendicular to the board.

The initial clearance $J_2$ present in the preceding phase between the surfaces 113 and 230 of the angle-bracket 100 and the block 200 is now transferred to the front of the rib 114, the two surfaces 113 and 230 being now in contact, the effect of which is to transmit the force applied by the tool 700 via the pressure block 200 to the angle-bracket 100 and to the pins 300.

This phase is completed when the front surface 112 of the mounting flange contacts the surface of the board, the pins 300 being then fully inserted into the through-plated holes 510 of the board 500 (this final position is that shown in FIGS. 6 and 7).

In the third and final phase of the mounting operation the tool 700 is removed, the effect of which is to release the load exerted on the various component parts of the connector and so to release the internal stresses which accumulated during the preceding phase due to deformation of the various parts of the insulative body and bending of the metal pins.

The pins then push back the pressure block 200, eliminating the clearance $J_3$ of the preceding phase and transferring this clearance rearwardly to generate the clearance $J_4$ between the surfaces 113 and 230 of the angle-bracket 100 and the pressure block 200. Given that the various component parts of the connector are subjected to some permanent deformation, the final clearance $J_4$ will be less than the initial clearance $J_2$ between the same two surfaces.

If the designed clearance $J_2$ is less than the elastic deformation of the pins (so that the surfaces 113 and 230 come into contact with each other during the second phase shown in FIGS. 6 and 7) and greater than the permanent deformation of the pins and the insulative body after complete forcing in of the pins and removal of the load (so that the final clearance $J_4$ has a non-null positive value) the outside surface 112 of the mounting flange 110 remains in contact with the surface of the board 500 ensuring optimal mechanical mounting and perfect conformance to the dimension d defining the position of the connecting members contained in the casing 400 relative to the board 500.

This absence of clearance between the insulative body of the connector and the printed circuit board is a characteristic feature of the invention and has not been achieved previously with prior art press-fit connectors having right-angled pins.

There is claimed:

1. Press-fit connector adapted to be fitted to a printed circuit board comprising an insulative body carrying a series of right-angled pins the proximal branches of which are substantially perpendicular to said board and have a profile enabling them to be force-fitted into through-plated holes of the printed circuit and the distal branches of which are substantially parallel to said board and configured as male or female connecting members, in which connector said insulative body comprises:

a part having the general shape of an angle-bracket with one flange substantially parallel to the board constituting a mounting flange whose outside surface is adapted to bear against the surface of the board and whose other flange is essentially perpendicular to said board and constitutes a connecting flange to which said distal branches of said pins are fastened, and a part constituting a pressure block having:

first bearing surfaces adapted to bear against said distal branches of said pins so as to exert on the latter by virtue of application of a force urging the block in a direction perpendicular to the board a force forcing said pins into respective through-plated holes, and second bearing surfaces adapted to bear against the lower surface of said mounting flange of said angle-bracket, the relative position of said first and second bearing surfaces being such that when said first bearing surfaces bear without clearance on said pins there remains a clearance between said second bearing surfaces and the inside surface of said mounting flange which is less than the elastic deformation under load perpendicular to said board of said pins when said force is applied whereby said mounting flange is urged against said board concomitantly with forcing of said pins into said through-plated holes, said clearance being greater than the permanent deformation perpendicular to said board of said pins and said insulative body after said pins are forced in completely and the load is removed, whereby the mounting side of said angle-bracket is held against said board.

* * * * *